US007761036B2

(12) United States Patent
Lee

(10) Patent No.: US 7,761,036 B2
(45) Date of Patent: Jul. 20, 2010

(54) IMAGE FORMING APPARATUS AND POWER TRANSMISSION UNIT THEREOF

(75) Inventor: Jung-jae Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 226 days.

(21) Appl. No.: 11/877,995

(22) Filed: Oct. 24, 2007

(65) Prior Publication Data

US 2008/0124129 A1 May 29, 2008

(30) Foreign Application Priority Data

Nov. 27, 2006 (KR) ..... 10-2006-0117708

(51) Int. Cl.
*G03G 15/01* (2006.01)

(52) U.S. Cl. ..... 399/223

(58) Field of Classification Search ..... 399/107, 399/111, 116, 117, 119, 159, 167, 222, 223
See application file for complete search history.

(56) References Cited

U.S. PATENT DOCUMENTS 6,035,159 A * 3/2000 Azuma et al. ..... 399/111
6,061,538 A * 5/2000 Arimitsu et al. ..... 399/111
6,345,164 B1 * 2/2002 Yokomori et al. ..... 399/119
6,501,927 B1 * 12/2002 Watanabe et al. ..... 399/117

FOREIGN PATENT DOCUMENTS

| | | |
|---|---|---|
| EP | 1178370 | 2/2002 |
| EP | 1211576 | 6/2002 |
| EP | 1653296 | 5/2006 |
| JP | 4-76565 | 3/1992 |
| JP | 2000-206754 | 7/2000 |
| JP | 2000-214654 | 8/2000 |
| JP | 2001-134094 | 5/2001 |
| JP | 2005-257875 | 9/2005 |

OTHER PUBLICATIONS

Office Action issued in corresponding European Patent Application No. 07120496.0 dated Mar. 5, 2008.

* cited by examiner

*Primary Examiner*—Hoan Tran
(74) *Attorney, Agent, or Firm*—Staas & Halsey LLP

(57) ABSTRACT

An image forming apparatus including: a driven rotational body that is detachable from the image forming apparatus and includes a driven connecting part; a transmission member that receives a rotational power and includes a driving connecting part provided along a direction of a rotational axial line of the driven rotational body; and an assembling member that receives the rotational power from the transmission member, transmits the rotational power to the driven rotational body to rotate the driven rotational body, and includes a driven side assembling part to connect to the driven connecting part, and a driving side assembling part to connect to the driving connecting part.

35 Claims, 16 Drawing Sheets

IMAGE FORMING APPARATUS AND POWER TRANSMISSION UNIT THEREOF

CROSS-REFERENCE TO RELATED APPLICATION

This application claims the benefit of Korean Patent Application No. 2006-117708, filed on Nov. 27, 2006 in the Korean Intellectual Property Office, the disclosure of which is incorporated herein by reference.

BACKGROUND OF THE INVENTION

1. Field of the Invention

Aspects of the present invention relate to an image forming apparatus and a power transmission unit thereof, and more particularly, to an image forming apparatus having a power transmission unit that can stably transmit power to a rotating body.

2. Description of the Related Art

In general, an electrophotographic image forming apparatus scans light onto a photosensitive drum electrified to a predetermined transmitting potential to form an electro-static latent image thereon. Then, the electrophotographic image forming apparatus develops the electro-static latent image into a predetermined color toner by a developing cartridge, and transfers and fuses the toner onto a print medium to thereby print a single-color image or a multi-color image on the print medium.

As shown in FIG. 1A, a conventional electrophotographic image forming apparatus 1 includes a photosensitive drum 10 and a plurality of developing cartridges 20 that are provided along an external circumference surface of the photosensitive drum 10.

The developing cartridges 20 store black (K), yellow (Y), magenta (M), and cyan (C) toners, and each include a developing roller 23 that is exposed to the photosensitive drum 10 side. Also, the developing cartridges 20 are detachable from a main body (not shown) of the image forming apparatus 1. A driven gear 23*a* is provided on one end part of a rotational axis of each of the developing rollers 23.

On a side frame 3 on a side of the image forming apparatus 1 are provided a drum driving coupling 4 to drive the photosensitive drum 10, and developing device driving gears 7C, 7M, 7Y, and 7K that engage the driven gears 23*a* of the developing rollers 23 if the developing cartridges 20 are mounted. A type in which a color image is formed by using one photosensitive drum 10, as shown in FIG. 1A, is called a multi-pass type. In the multi-pass type, each of the developing cartridges 20 must be sequentially driven to form the color image.

Referring to FIG. 1B, only two of the four developing device driving gears 7Y and 7K of FIG. 1A have been illustrated for a convenience of description as they have the same operating configurations. The developing device driving gears 7Y and 7K engage connecting gears 6Y and 6K if power is transmitted, and disengage the connecting gears 6Y and 6K if power is blocked. The connecting gears 6Y and 6K are engaged and disengaged with/from the developing device driving gears 7Y and 7K by cams 5Y and 5K that rotate with respect to a rotating axis 5*a* at a proper time.

However, in the conventional image forming apparatus 1, the degree of teeth-engagement between the developing device driving gears 7C, 7M, 7Y, and 7K and the driven gears 23*a* may be different by a manufacturing tolerance and an assembling position tolerance of parts if each of the developing cartridges 20 is mounted. Accordingly, a strict common difference control has to be performed to stably drive the developing cartridges 20 in a single part and assembling parts, thereby raising a manufacturing cost.

Also, as shown in FIG. 1A, an interval G between the developing roller 23 and the photosensitive drum 10 differs according to the developing cartridges 20. Accordingly, the density of the toner differs according to each color. As a result, the color image formed by toners having different densities may be an inferior image (such as a distorted color).

SUMMARY OF THE INVENTION

Aspects of the present invention provide an image forming apparatus and a power transmission unit thereof that can stably transmit power to a developing cartridge to save a manufacturing cost, and decrease an inferior image quality.

According to an aspect of the present invention, there is provided an image forming apparatus including: a driven rotational body that is detachable from the image forming apparatus and includes a driven connecting part; a transmission member that receives a rotational power and includes a driving connecting part provided along a direction of a rotational axial line of the driven rotational body; and an assembling member that receives the rotational power from the transmission member, transmits the rotational power to the driven rotational body to rotate the driven rotational body, and includes a driven side assembling part to connect to the driven connecting part, and a driving side assembling part to connect to the driving connecting part.

The transmission member may include a power receiving part to receive the rotational power, and a driving part to drive the power receiving part.

The image forming apparatus may further include a first selectively connecting part to selectively move the transmission member along the direction of the rotational axial line so that the driving connecting part engages or disengages from the driving side assembling part of the assembling member.

The first selectively connecting part may include a cam and/or a solenoid.

The image forming apparatus may further include a controller to control the first selectively connecting part to engage the driving connecting part with the driving side assembling part if the driven rotational body requires the rotational power.

The image forming apparatus may further include a second selectively connecting part to selectively move the assembling member along the direction of the rotational axial line so that the driven side assembling part engages or disengages from the driven connecting part of the rotational body.

The second selectively connecting part may include: a first selectively connecting member to rotate around the rotational axial line; and a second selectively connecting member connected to the assembling member such that the second selectively connecting member moves together with the assembling member toward or away from the driven connecting part according to a direction that the first selectively connecting member rotates.

The first selectively connecting member may include a cam provided along a circumference around the rotational axial line, and the second selectively connecting member may include a cam profile that reciprocally operates in contact with the cam.

The first selectively connecting member may include a force operating part to receive a rotational moment from an outside source enabling the first selectively connecting member to rotate.

The image forming apparatus may further include a cover that opens and closes, wherein the first selectively connecting member rotates in a first direction when the cover opens and rotates in a second direction when the cover closes.

The image forming apparatus may further include an elastic member provided between the assembling member and the transmission member to apply an elastic force in a direction to separate the assembling member and the transmission member from each other.

According to another aspect of the present invention, there is provided a power transmission unit to transmit a rotational power to a driven rotational body having a driven connecting part, the power transmission unit including: a transmission member that receives the rotational power and includes a driving connecting part provided along a direction of a rotational axial line of the driven rotational body; and an assembling member that receives the rotational power from the transmission member, transmits the rotational power to the driven rotational body, and includes: a driven side assembling part to connect to the driven connecting part, and a driving side assembling part to connect to the driving connecting part.

The power transmission unit may include: an elastic member provided between the assembling member and the transmission member to apply an elastic force in a direction to separate the assembling member and the transmission member from each other; wherein the transmission member includes a power receiving part to receive the rotational power.

The power transmission unit may further include a first selectively connecting part to selectively move the transmission member along the direction of the rotational axial line so that the driving connecting part engages or disengages from the driving side assembling part of the assembling member.

The first selectively connecting part may include a cam and/or a solenoid.

The power transmission unit may further include a controller to control the first selectively connecting part to engage the driving connecting part with the driving side assembling part if the driven rotational body requires the rotational power.

The power transmission unit may include a second selectively connecting part to selectively move the assembling member along the direction of the rotational axial line so that the driven side assembling part engages or disengages from the driven connecting part of the driven rotational body.

The second selectively connecting part may include: a first selectively connecting member to rotate around the rotational axial line; and a second selectively connecting member connected to the assembling member such that the second selectively connecting member moves together with the assembling member toward or away from the driven connecting part according to a direction that the first selectively connecting member rotates.

The first selectively connecting member may include a circumference cam provided along a circumference around the rotational axial line, and the second selectively connecting member may include a circumference cam profile that reciprocally operates in contact with the cam.

The first selectively connecting member may include a force operating part to receive a rotational moment from an outside source enabling the first selectively connecting member to rotate.

The second selectively connecting member may be interposed between the assembling member and the first selectively connecting member and may move along a rotational axis line while interlocking with the assembling member.

The power transmission unit may further include a side frame to prevent the first selectively connecting member from being separated toward the driven connecting part by the elastic force, wherein the first selectively connecting member and the side frame may be formed as a single body.

According to another aspect of the present invention, there is provided an image forming apparatus including a cover and a detachable driven rotational body having a driven connecting part to receive a rotational power, the image forming apparatus including: an assembling member comprising a driven side assembling part to connect to the driven connecting part and to transmit the rotational power to the driven connecting part; and a selectively connecting part to connect or disconnect the driven side assembling part to/from the driven connecting part by moving the assembling member toward or away from the driven connecting part according to an opening or a closing of the cover.

According to another aspect of the present invention, there is provided a method of transmitting a rotational power in an image forming apparatus to a detachable driven rotational body having a driven connecting part, the method including: connecting a driven side assembling part of an assembling member of the image forming apparatus to the driven connecting part; transmitting the rotational power from the assembling member to the driven rotational body when the assembling member and the driven rotational body are connected; and disconnecting the driven side assembling part and the driven connecting part when a cover of the image forming apparatus is opened.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
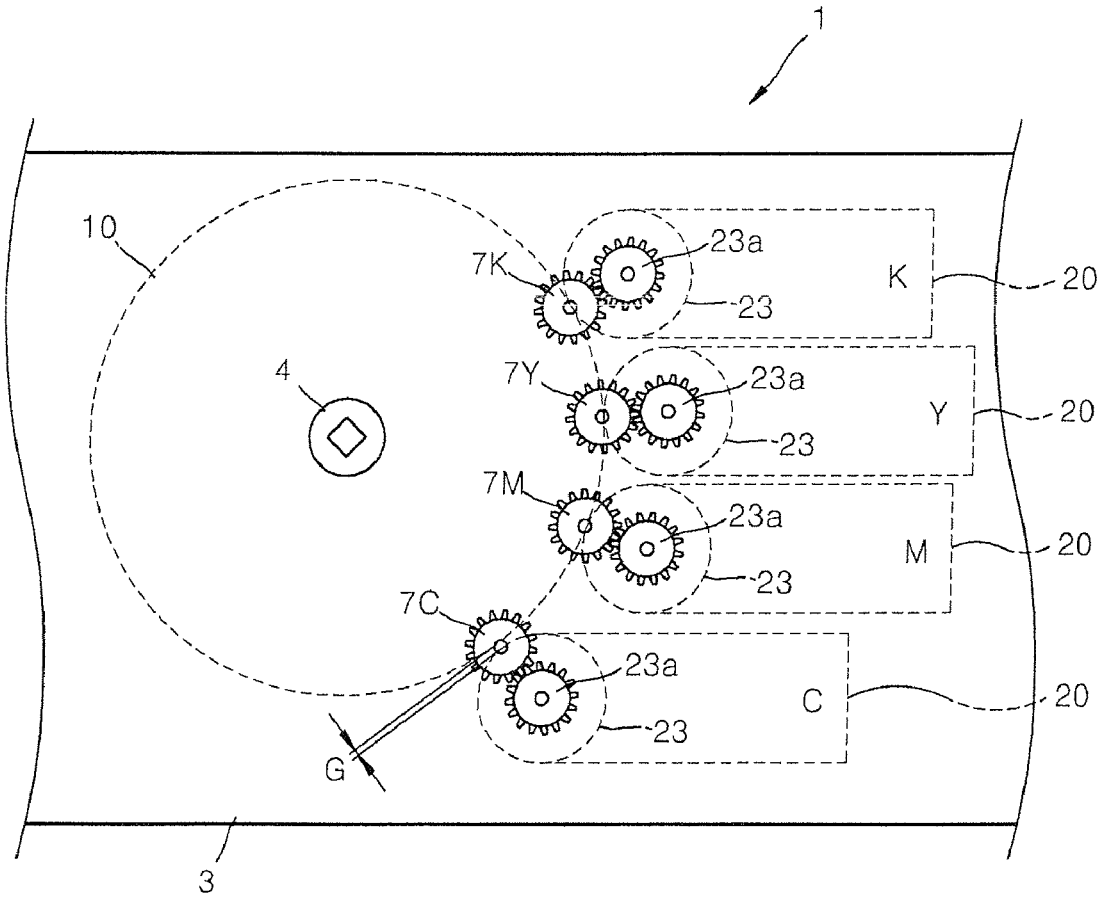
FIG. 1A (RELATED ART)
FIGS. 1A and 1B are a side view and a sectional view, respectively, of a conventional image forming apparatus.
Figure 1B:
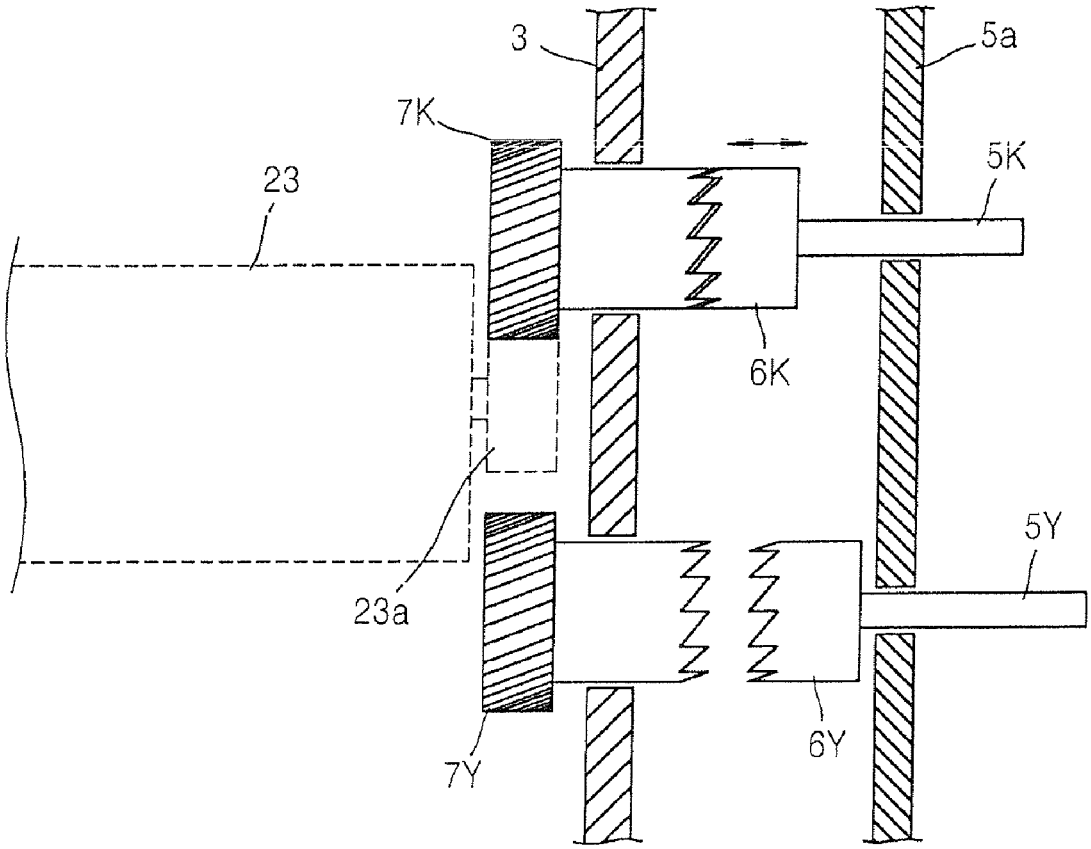
FIG. 1B (RELATED ART)

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
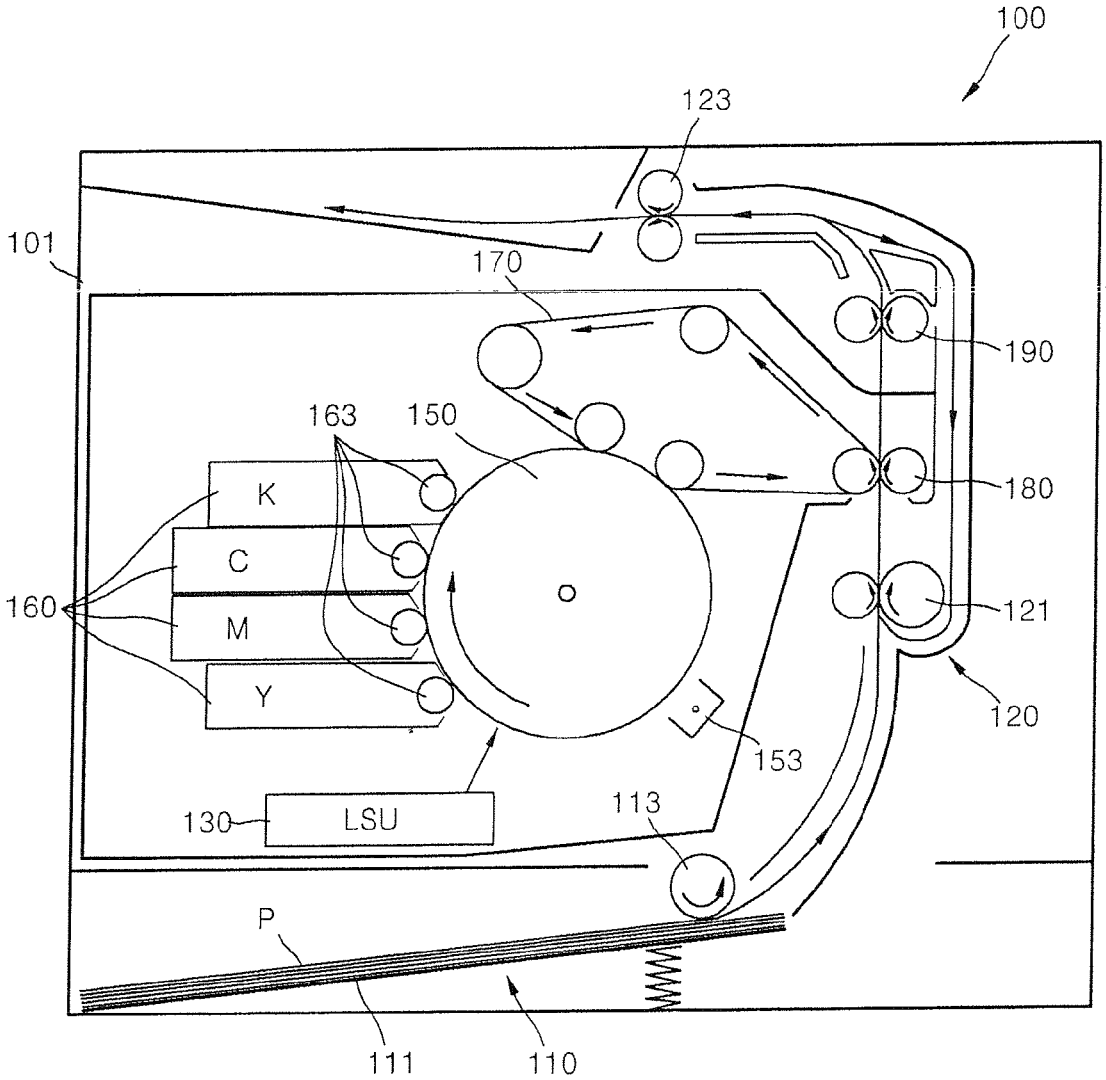
FIG. 2 is a sectional view of an image forming apparatus according to an embodiment of the present invention.

As shown in FIG. 2, an image forming apparatus 100 according to aspects of the present invention includes, within a housing 101, a paper feeding cassette 110, a paper supplying unit 120, a light scanning unit (LSU) 130, a photosensitive drum 150, an electrifying unit 153, a plurality of developing cartridges 160, a transfer belt 170, a transfer roller 180, and a fusing unit 190.

Figure 3:
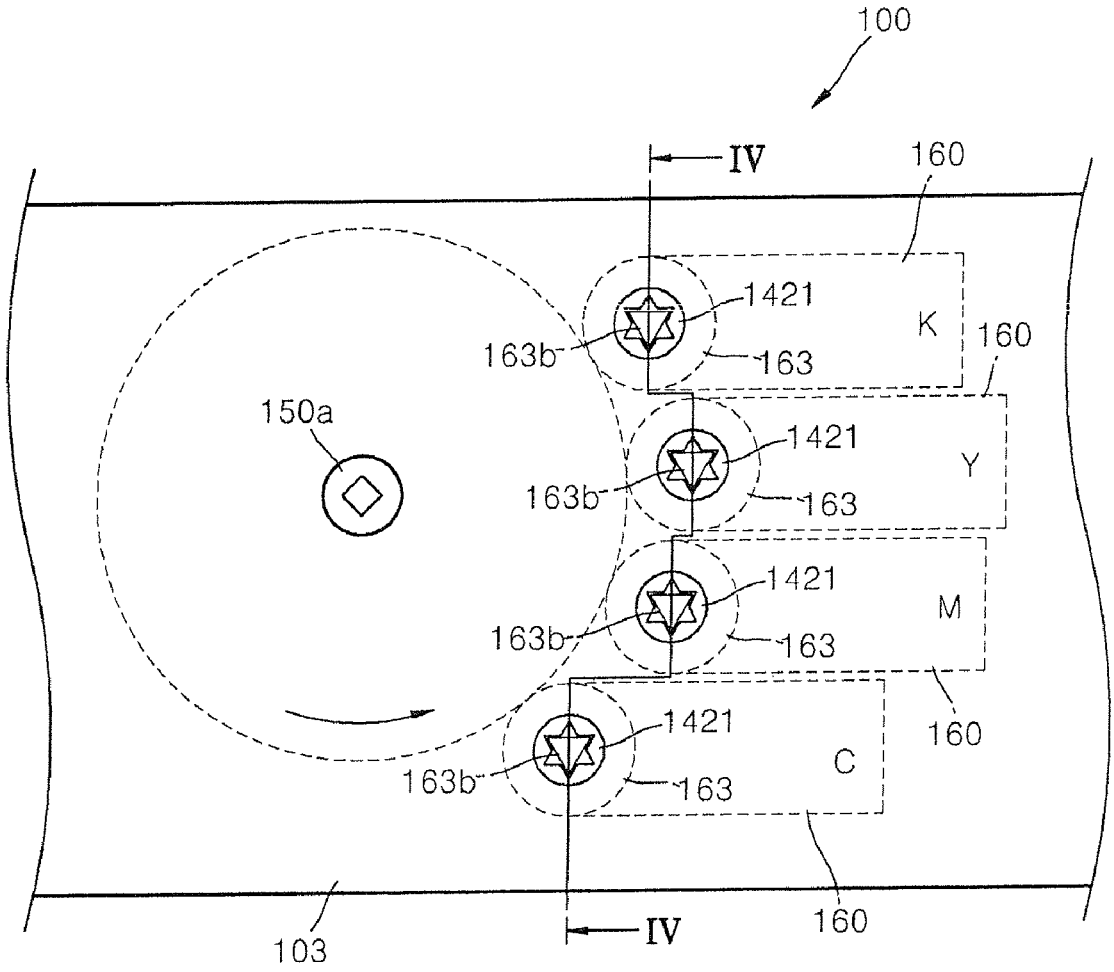
FIG. 3 is an inside view of an image forming apparatus according to an embodiment of the present invention.
Figure 4:
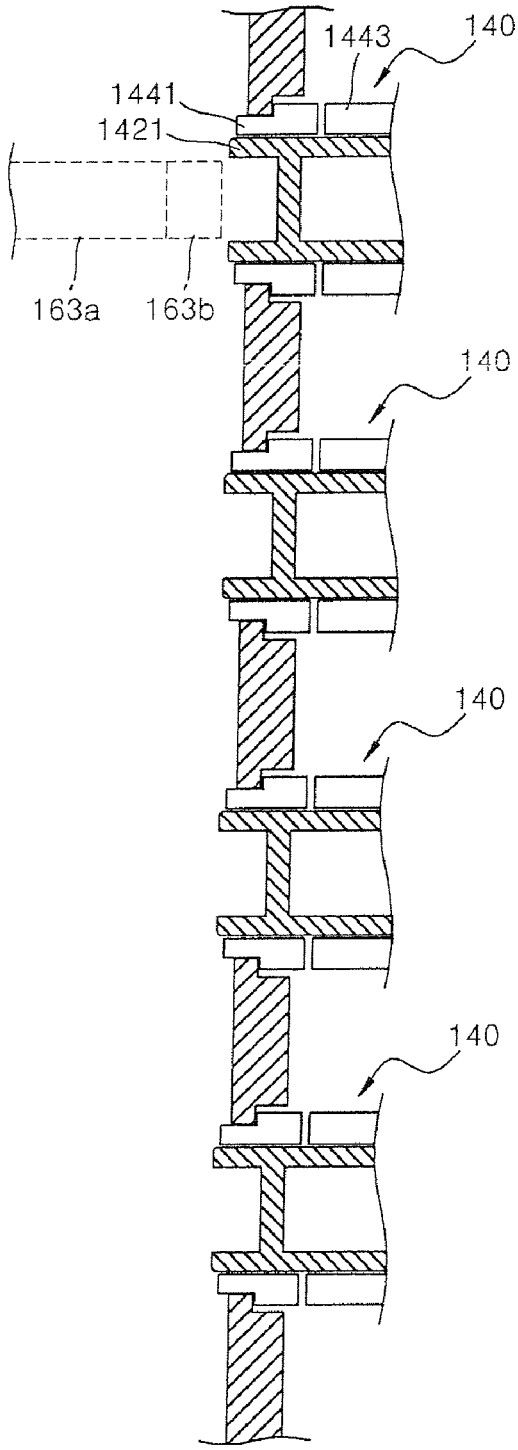
FIG. 4 is a sectional view of an image forming apparatus according to an embodiment of the present invention.

As shown in FIGS. 3 and 4, the developing cartridges 160 store toner of a predetermined color (such as black, yellow, magenta, and cyan). The developing cartridges 160 each include a developing roller 163 to develop an electrostatic latent image on the photosensitive drum 150. A driven connecting part 163*b* is provided on one end part of a rotational axis 163*a* of the developing roller 163 in order to receive a rotational power from a driving motor (not shown). The driven connecting part 163*b* rotates in a direction of the rotational axial line of the rotational axis 163*a* and is provided to engage (or connect to) a driven side assembling part 1421 having a corresponding shape. The driven side assembling part 1421 transmits power to the driven connecting part 163*b*. The driven connecting part 163*b* may, although not necessarily, be provided to have a projected shape, and the driven side assembling part 1421 may be provided to have a caved-in shape. However, it is understood that the projected shape and caved-in shape are just examples, and the driven connecting part 163*b* and the driving connecting part may be provided to have other shapes or methods to connect, engage, or latch onto each other, and the caved in shape can instead be on the driven side assembling part 1421, and the projected shape can be on the driven connecting part 163*b*.

Referring to FIG. 2, an image forming process of the image forming apparatus 100 will now be described. First, the electrifying unit 153 supplies a transmission charge to the photosensitive drum 150 to electrify the surface of the photosensitive drum 150 to a uniform transmitting potential. Then, the LSU 130 scans light corresponding to image information of, for example, cyan (C) onto the photosensitive drum 150 to form an electrostatic latent image on which a cyan toner will be sprayed. After that, a first selectively connecting part (see 1430 in FIG. 6) of a power transmission unit (see 140 in FIG. 5), to be described later, transmits power to a cyan developing cartridge 160C. Accordingly, a developing roller 163C of the cyan developing cartridge 160C supplies cyan toner to the electrostatic latent image to develop the electrostatic latent image, thereby forming a cyan toner image. The toner image is transferred to the transfer belt 170. It is understood that cyan (C) and the cyan toner are provided as an example, and other colors may be used.

After the cyan toner image is transferred to the transfer belt 170, magenta, yellow, and black toner images, for example, are transferred to the transfer belt 170. Accordingly, a complete color toner image is formed on the transfer belt 170. Meanwhile, a print medium P stored on a knock-up plate 111 is picked up by a pick-up roller 113 and supplied to a feeding roller 121. The feeding roller 121 feeds the print medium P between the transfer belt 170 and the transfer roller 180 so that the color toner image can be transferred on to the print medium P. Accordingly, the color toner image on the transfer belt 170 is transferred onto the print medium P, and passes through the fusing part 190 to be fused on the print medium P. The image-formed print medium P through this process is discharged to the outside by a discharging roller 123. While not limited thereto, the printing medium P can be paper, transparencies, or any medium on which toner images can be imparted.

Figure 5:
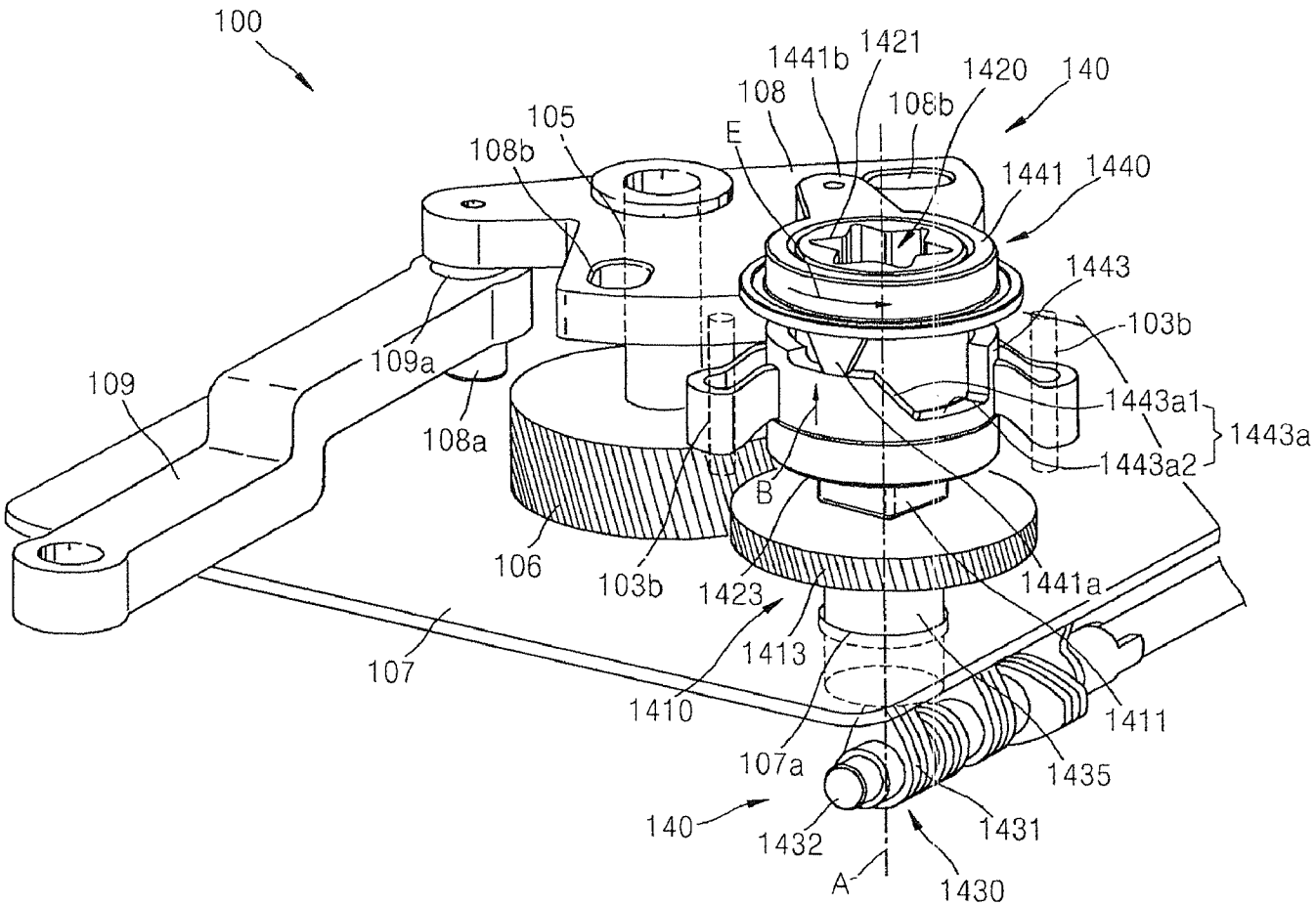
FIG. 5 is a perspective view of a power transmission unit according to an embodiment of the present invention.
Figure 6:
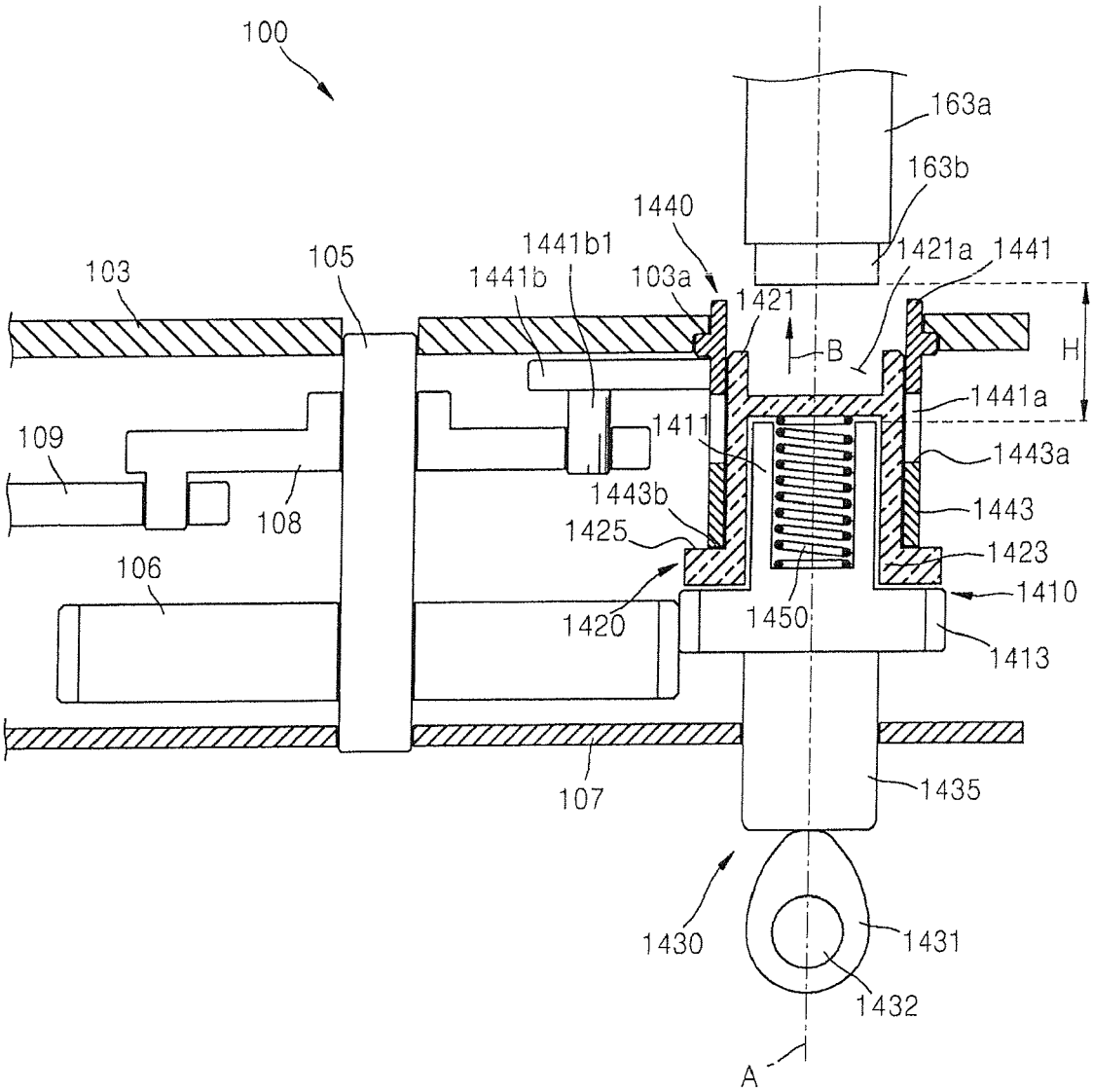
FIG. 6 is a sectional view of a power transmission according to an embodiment of the present invention.

Meanwhile, as shown in FIGS. 4 to 6, the image forming apparatus 100 according to aspects of the present invention further includes a power transmission unit 140 that may be provided between a side frame 103 and an inside frame 107 of the image forming apparatus 100. According to an aspect of the present invention, the number of power transmission units 140 provided is equal to the number of developing cartridges 160 provided. For example, referring to FIG. 4, four developing cartridges 160 may correspond to four power transmission units 140.

FIGS. 5 and 6 are a perspective view and a sectional view of a power transmission unit 140, respectively, in a state in which a cover (not shown) is opened. For convenience in the present description, the side frame 103, the rotational axis 163*a* of the developing roller 163, and the driven connecting part 163*b* illustrated in FIG. 6 have been omitted in FIG. 5.

As shown in FIGS. 5 and 6, the power transmission unit 140 includes a transmission member 1410, an assembling member 1420, a first selectively connecting part 1430, and a second selectively connecting part 1440.

The transmission member 1410 includes a power receiving part 1413 that receives the power. The power receiving part 1413 is assembled or contacted with a power distributing gear 106 that distributes a rotational power and is connected to a driving motor (not shown). The transmission member 1410 further includes the driving connecting part 1411 that transmits the power to the driven connecting part 163*b*.

The power receiving part 1413 is provided to engage the teeth of the power distributing gear 106, and may be provided in the shape of teeth. However, it is understood that methods other than corresponding teeth may be used to engage the power receiving part 1413 with the power distributing gear 106.

The driving connecting part 1411 is provided to rotate along a rotational axial line A of the rotational axis 163*a* of the developing roller 163. The driving connecting part 1411 may be separated by as much as a predetermined mid-transmitting section H from the driven connecting part 163*b*. The mid-transmitting section H may be determined in consideration of the shape and a moving displacement of the assembling member 1420 (to be described later) in relation to the rotational axial line A, an amount of elasticity of an elastic member 1450, and the shape of the first selectively connecting part 1430.

The driving connecting part 1411 is illustrated to have a square-sectional projected shape in FIG. 5, but it is not limited thereto and may be provided in any shape so long as the driving connecting part 1411 can transmit the rotational power to a driving side assembling part 1423 (to be described later) in the direction of the rotational axial line A. In the inside of the driving connecting part 1411 may be provided an elastic member inserting hole into which the elastic member 1450 is inserted.

Meanwhile, the assembling member 1420 is provided in the mid-transmitting section H to move in the direction of the rotational axial line A. As shown in FIGS. 4, 5, and 6, in one end part of the assembling member 1420 is provided a driven side assembling part 1421 that engages and disengages with/from the driven connecting part 163*b* in the direction of the rotational axial line A. Furthermore, in an opposite end part of the assembling member 1420 is provided the driving side assembling part 1423 that engages and disengages with/from the driving connecting part 1411 of the transmission member 1410. A driven connecting part inserting hole 1421*a* into which the driven connecting part 163*b* can be inserted is provided in the driven side assembling part 1421. A driving connecting part inserting hole (see 1423*a* in FIG. 7A) into which the driving connecting part 1411 can be inserted is provided in the driving side assembling part 1423.

At least one of the driven side assembling part 1421 and the driving side assembling part 1423 may be provided as a female coupling having a caved-in shape, and the driven connecting part 163*b* and the driving connecting part 1411 may be provided as a male coupling having a projected shape, as necessary. However, it is understood that according to other aspects, the driven side assembling part 1421 and/or the driving side assembling part 1423 may be provided as a male coupling having a projected shape, and the driven connecting part 163*b* and/or the driving connecting part 1411 may be provided as a female coupling having a caved-in shape. Also, it is also understood that methods of engaging other than a projection fitting into a caved-in area may be provided so long as the driven side assembling part 1421, the driving side assembling part 1423, the driven connecting part 163*b*, and the driving connecting part 1411 can be rotated in engagement with the direction of the rotational axial line A.

For the sake of conveniently describing aspects of the present invention, a direction of the driving connecting part 1411 moving toward the driven connecting part 163*b* is described as an upward direction, and a direction of the driving connecting part 1411 separating from the driven connecting part 163*b* is described as a downward direction. However, it is understood that according to other aspects of the present invention, other directions may be applied depending on the relative configuration of the driving connecting part 1411 and the driven connecting part 163*b*.

As shown in FIGS. 4, 5, and 6, the second selectively connecting part 1440 includes a first selectively connecting member 1441 and a second selectively connecting member 1443. The second selectively connecting part 1440 enables the assembling member 1420 to move upward and downward along the rotational axial line A so that the driven side assembling part 1421 of the assembling member 1420 can selectively engage (or connect) and disengage (or separate) with/from the driven connecting part 163*b*.

The first selectively connecting member 1441 may include a hitching part (not shown) that is hitched on a hitching projection 103*a* of the side frame 103 to prevent the first selectively connecting member 1441 from being separated toward the driven connecting part 163*b*. The first selectively connecting member 1441 is provided to rotate. The first selectively connecting member 1441 further includes a circumference cam 1441*a* that is projected from a circumference of the first selectively connecting member 1441 in the direction of the rotational axial line A to a side of the second selectively connecting member 1443. The first selectively connecting member 1441 may also include a force operating part 1441*b* to receive a rotational moment from an outside source.

The force operating part 1441*b* may include a link plate inserting projection 1441*b*1, which is projected from an external side of the first selectively connecting member 1441 to be inserted into an inserting hole 108*b* of a link plate 108 to be described later. The link plate 108 has an inserting projection 108*a*, and the inserting projection 108*a* is inserted into an inserting hole 109*a* of a cover connecting rod 109 that moves in engagement with an opening and a closing of a cover (not shown). Also, the link plate 108 is provided to rotate with respect to a stud 105 in parallel with the rotational axial line A. Accordingly, the link plate 108 rotates in forward and reverse directions with respect to the stud 105 if the cover is opened or closed. The number of inserting holes 108*b* of the link plate 108 is provided to correspond to the number of developing rollers 163 of the developing cartridges 160 that require power transmission. That is, for example, if there are four developing rollers 163, then four inserting holes 108*b* are provided. Moreover, the power transmission unit 140 may be provided in each position of the inserting holes 108*b*. However, for convenience's sake, only one of them is illustrated in the drawing.

The second selectively connecting member 1443 is provided to move together with the assembling member 1420. To do so, a selectively connecting member connecting part 1425 is extended from the driving side assembling part 1423 of the assembling member 1420 in a radial direction to contact an assembling member connecting part 1443*b* of the second selectively connecting member 1443. Also, the second selectively connecting member 1443 may include a guide groove part 1443*c* (illustrated in FIG. 10) projected from an external side. The guide groove part 1443*c* is inserted into the guide projection 103*b* projected from the side frame 103 to the rotational axial line A on the side of the second selectively connecting member 1443 to enable the selectively connecting member 1443 to move upward and downward along the guide projection 103*b*.

The second selectively connecting member 1443 includes a circumference cam profile 1443*a* that reciprocally operates in contact with the circumference cam 1441*a* in the rotational axial line A of the first selectively connecting member 1441. The circumference cam 1441*a* and the circumference cam profile 1443*a* enable the second selectively connecting member 1443 to approach and separate from the driven connecting part 163*b* according to the rotational direction of the first selectively connecting member 1441. That is, as the first selectively connecting member 1441 rotates in a forward rotating direction E, the circumference cam 1441*a* rotates in the forward rotating direction E. A sliding surface 1443*a*1 of the circumference cam profile 1443*a* is contacted with the circumference cam 1441*a* and the second selectively connecting member 1443 gradually rotates in an upward direction B. The second selectively connecting member 1443 gradually rotates to move in the upward direction B until the second selectively connecting member 1443 contacts the first selectively connecting member 1441 and is prevented from moving in the upward direction B. The second selectively connecting member 1443 may be limited to rotate and move in the upward direction B due to contact by the circumference cam 1441 a with a rotation restricting surface 1443*a*2 of the circumference cam profile 1443*a*. However, it is understood that the second selectively connecting member 1443 may be limited in rotating or moving in the upward direction B in various ways. However, the driven side assembling part 1421 of the assembling member 1420 and the driven connecting part 163*b* engage each other in a state that the second selectively connecting member 1443 has completed a rotation or movement in the upward direction (for example, when the circumference cam 1441*a* and the rotation restricting surface 1443*a*2 are in contact with each other). The circumference cam 1441*a* and the circumference cam profile 1443*a* may be provided in various shapes in addition to that illustrated in the drawings.

Meanwhile, if the first selectively connecting member 1441 rotates in a reverse direction with respect to the forward rotating direction E when the first selectively connecting member 1441 and the second selectively connecting member 1443 are in contact (as described above), the first selectively connecting member 1441 and the second selectively connecting member 1443 separate from each other by as much as a projected length of the circumference cam 1441*a*, and accordingly, the driven side assembling part 1421 disengages from the driven connecting part 163*b*. Therefore, the second selectively connecting part 1440 can selectively transmit the power of the assembling member 1420 to the driven connecting part 163*b*. Furthermore, the first selectively connecting part 1430 (to be described later) can selectively transmit the power of the transmission member 1410 to the assembling member 1420. Also, the first selectively connecting part 1430 and the second selectively connecting part 1440 may selectively connect the power between each other.

The first selectively connecting part 1430 enables the transmission member 1410 to selectively move upward or downward along the rotational axial line A, and the driving side assembling part 1423 of the assembling member 1420 and the driving connecting part 1411 of the transmission member 1410 to engage (or connect) and disengage (or separate) with/from each other. Accordingly, the rotational power transmitted from the power distributing gear 106 to the transmission member 1410 is selectively transmitted to the assembling member 1420.

The first selectively connecting part 1430 may include a switching cam 1431, a switching cam axis 1432, and a cam medium member 1435. If the switching cam 1431 directly contacts the transmission member 1410 to enable the transmission member 1410 to move upward and downward in the direction of the rotational axial line A, the cam medium member 1435 may be omitted. In the inside frame 107 is formed a through hole 107*a* through which the cam medium member 1435 may move upward and downward. The number and the shape of the switching cam 1431 may be properly determined according to the number of the developing cartridges 160 that need power transmitted thereto (for example, four). Meanwhile, the first selectively connecting part 1430 may include a solenoid (not shown) to perform the above-described function. A controller (not shown) may be further provided so as to control the rotating direction or speed of the switching cam 1431, and power to drive the switching cam 1431, as necessary.

A linear motor (not shown) may be used to move at least one of the transmission member 1410 and the assembling member 1420 along the direction of the rotational axial line A, as necessary. It is understood that if the transmission member 1410 and the assembling member 1420 can be moved along the direction of the rotational axial line A (for example, if the linear motor can be reversely-operated), then the first selectively connecting part 1430 and/or the second selectively connecting part 1440 may be omitted.

Meanwhile, the power transmission unit 140 may further include the elastic member 1450. As shown in FIG. 6, the elastic member 1450 is provided between the transmission member 1410 and the assembling member 1420, and applies an elastic force in a direction to separate the transmission member 1410 from the assembling member 1420. Specifically, the assembling member 1420 may be elastically pressurized toward the driven connecting part 163*b*, and the transmission member 1410 may be elastically pressurized toward the switching cam 1431.

Figure 7A:
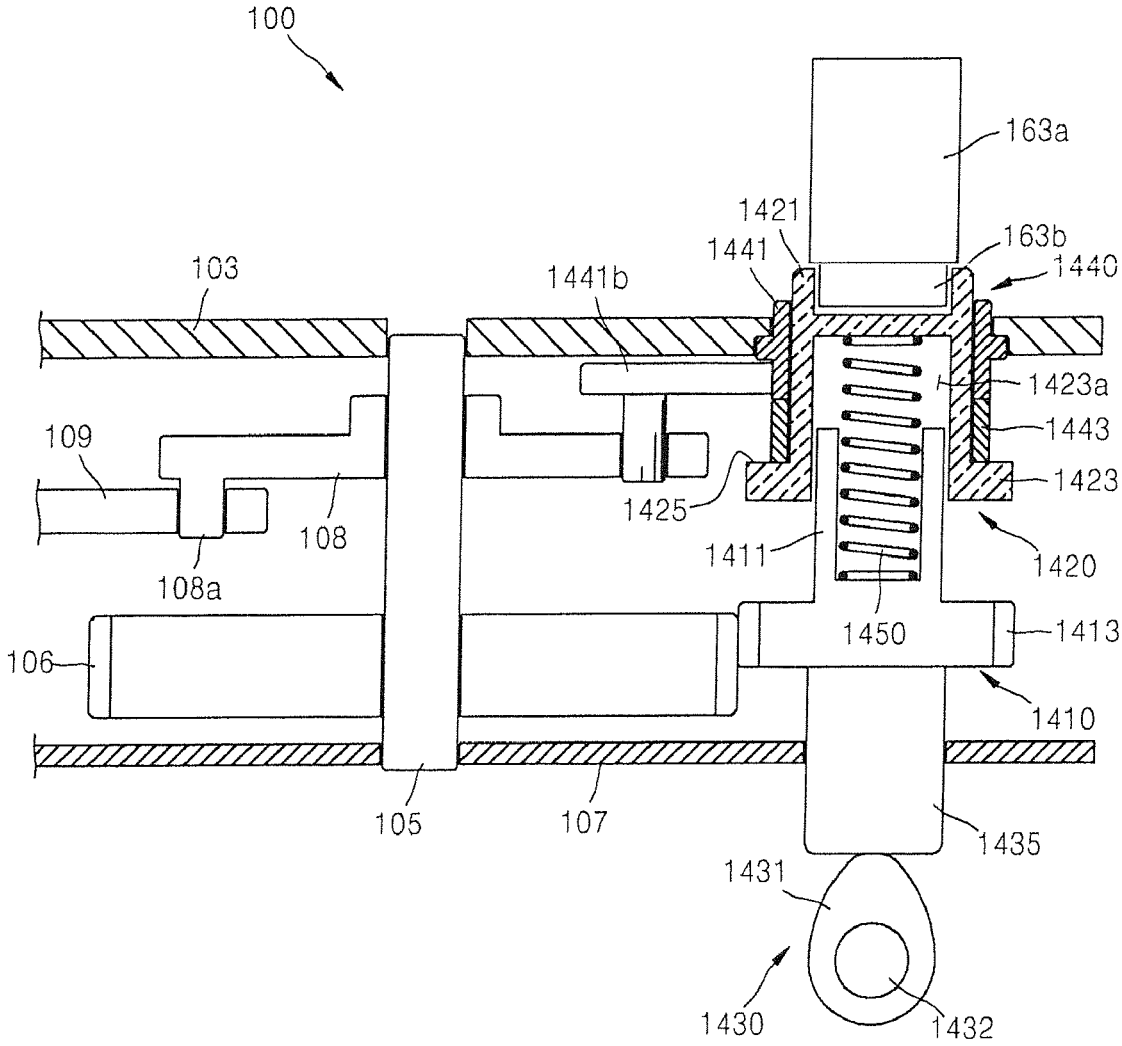
FIGS. 7A and 7B are sectional views illustrating an operation process of a power transmission unit according to an embodiment of the present invention.
Figure 7B:
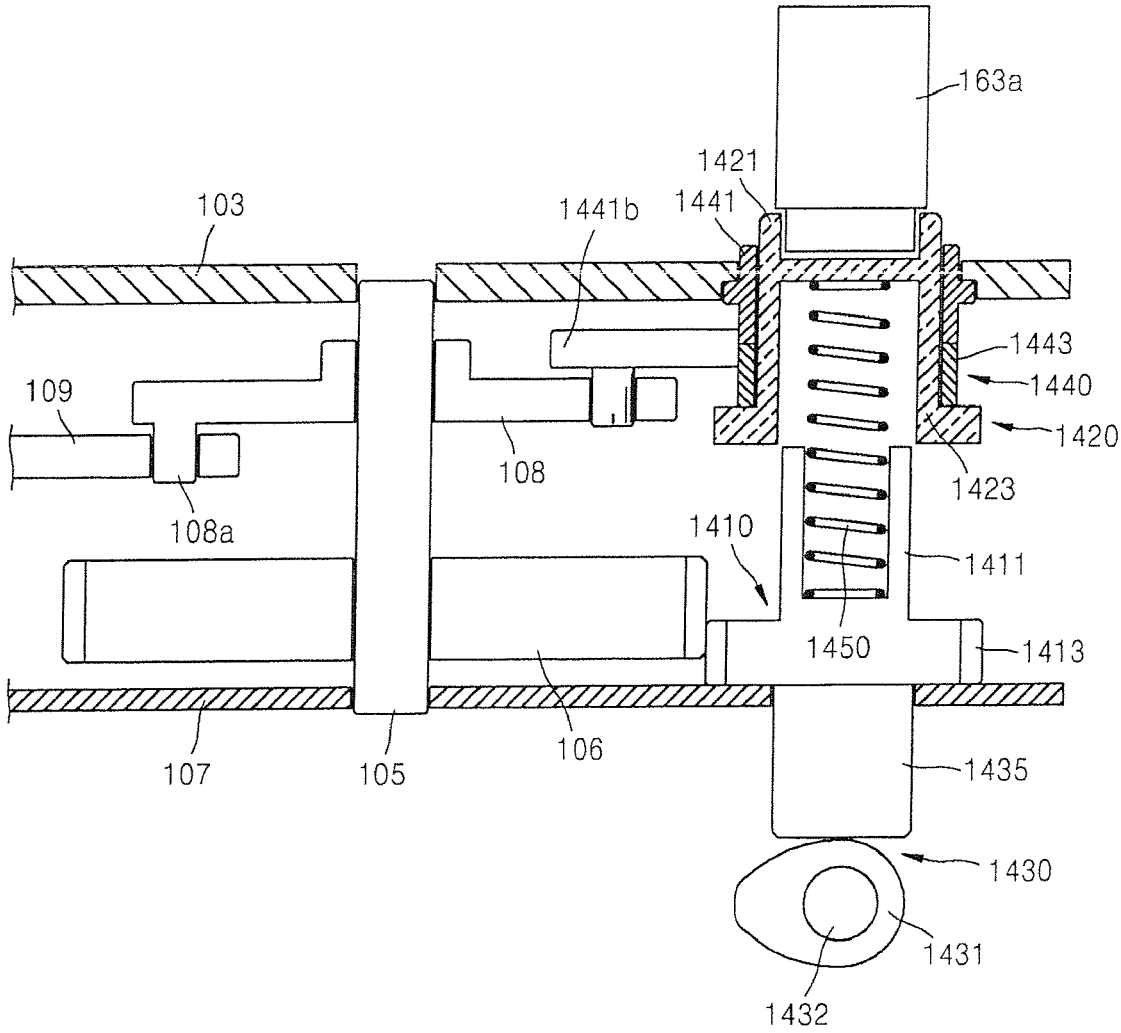

FIGS. 7A and 7B are sectional views illustrating a position where power is transmitted and a position where power is blocked, respectively, between the transmission member 1410 and the assembling member 1420 according to the rotation of the switching cam 1431 of the first selectively connecting part 1430. Here, the cover (not shown) is closed and the second selectively connecting part 1440 has moved the assembling member 1420 to rotate so that the driven side assembling part 1421 of the assembling member 1420 engages or contacts the driven connecting part 163*b* of the developing roller (see 163 in FIG. 2). An operating process opening and closing the cover will be described later. Accordingly, as the driving connecting part 1411 of the transmission member 1410 and the driving side assembling part 1423 of the assembling member 1420 are engaged (FIG. 7A) and disengaged (FIG. 7B), the power is transmitted and blocked, respectively, to the developing roller 163.

As shown in FIG. 7A, the switching cam 1431 of the first selectively connecting part 1430 pushes up the cam medium member 1435 to engage the driving connecting part 1411 with the driving side assembling part 1423. As a result, the power is transmitted from the power distributing gear 106 to the assembling member 1420 via the transmission member 1410. Accordingly, the rotational axis 163*a* having the driven connecting part 163*b* rotates to drive the developing cartridges 160.

As shown in FIG. 7B, if the elastic member 1450 elastically pressurizes the assembling member 1420 toward the driven connecting part 163*b* and/or the transmission member 1410 downwardly moves due to a rotation of the switching cam 1431, the driving side assembling part 1423 of the assembling member 1420 and the driving connecting part 1411 of the transmission member 1410 disengage from each other. As a result, the power is not transmitted from the power distributing gear 106 to the assembling member 1420, therefore blocking the power transmission to the developing cartridges 160. It is understood that according to aspects of the present invention, the elastic member 1450 may be omitted, and the assembling member 1420 may be pressured by other methods (such as electronically) or may not be pressured while the transmission member 1410 moves up and down according to a rotation of the switching cam 1431.

Figure 8A:
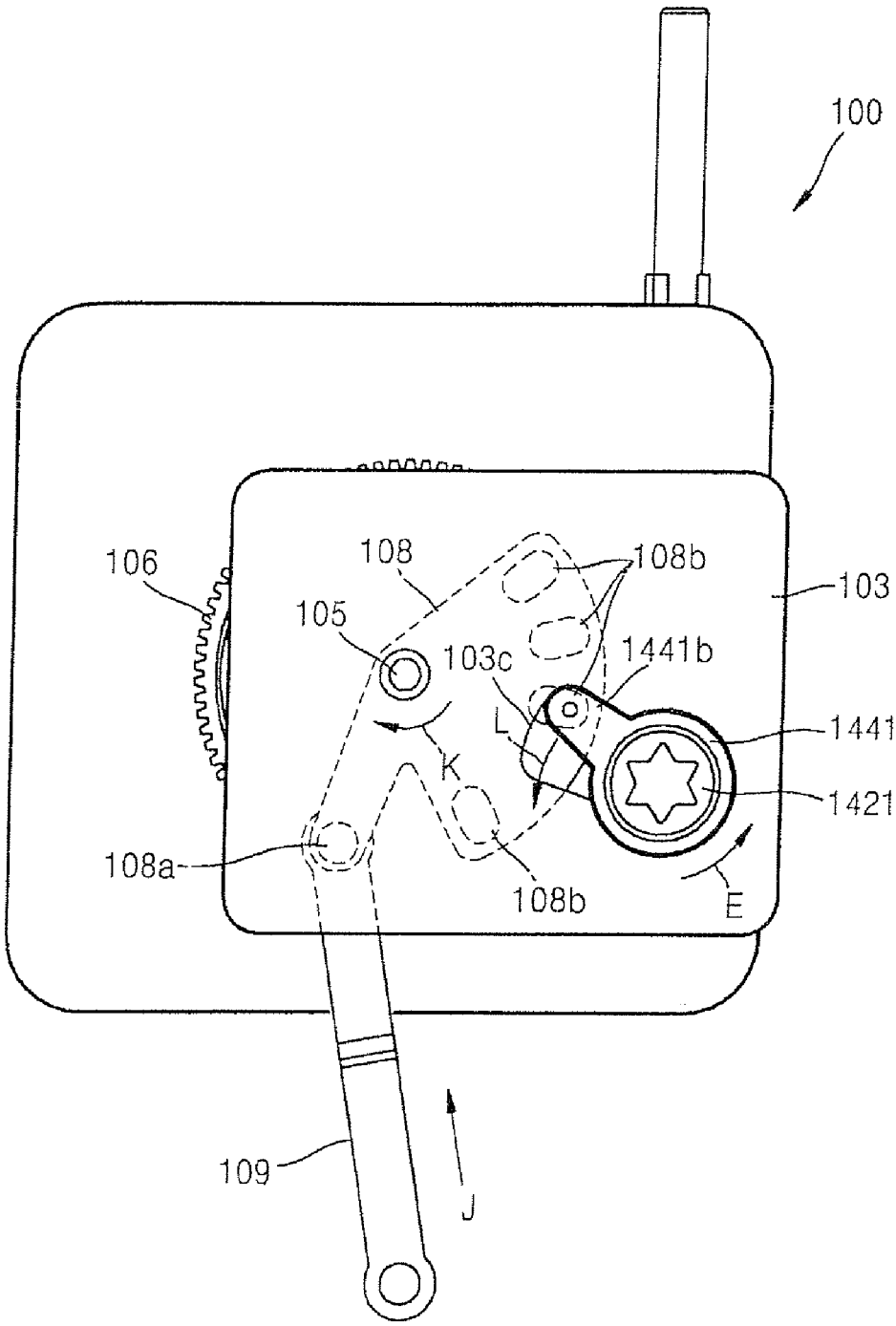
FIGS. 8A and 8B are drawings illustrating an engaging operation process of a power transmission unit if a cover is opened and closed according to an embodiment of the present invention.
Figure 8B:
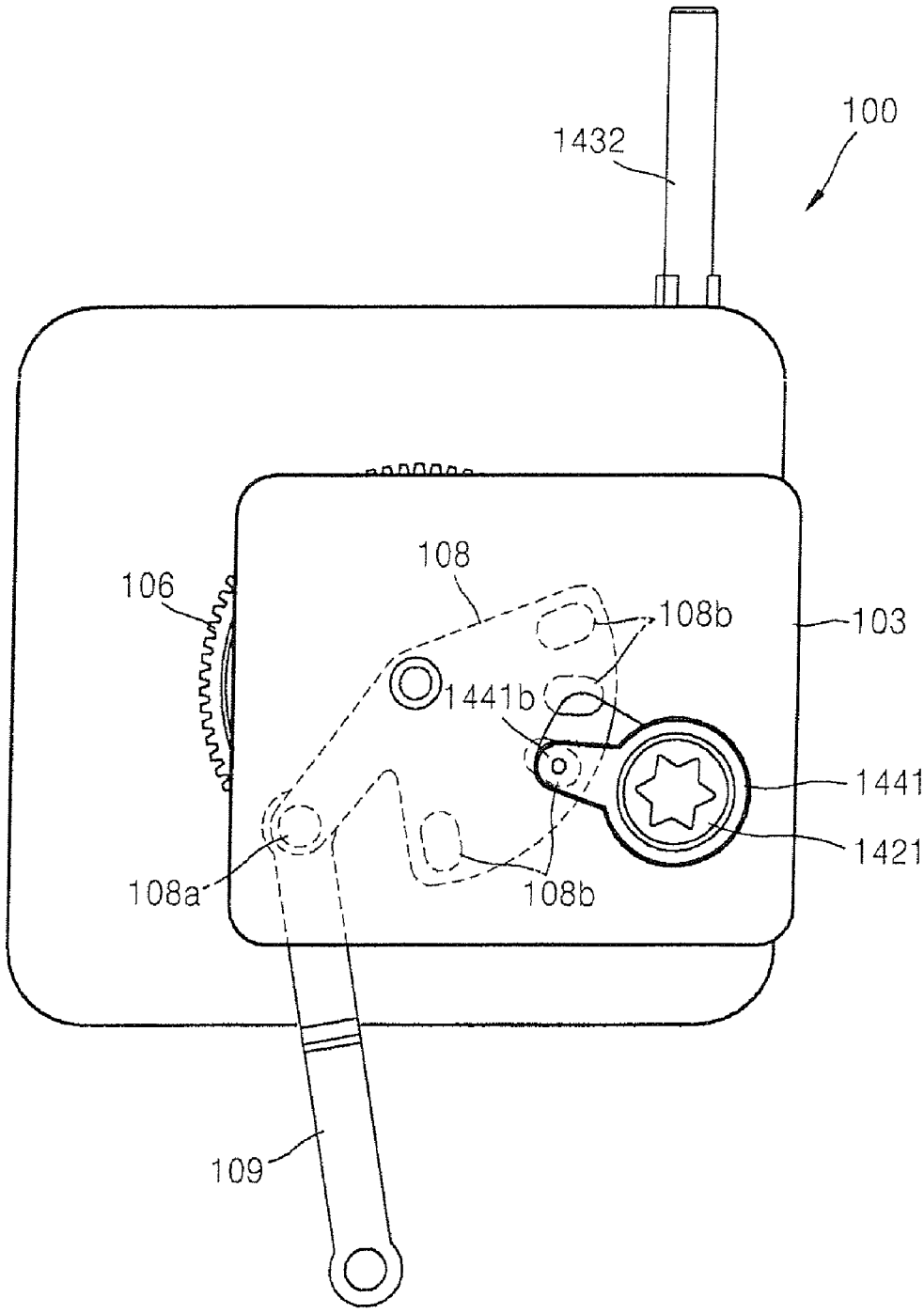

FIG. 8A is a plane view of the power transmission unit 140 in a state that the cover is opened, and FIG. 8B is a plane view of the power transmission unit 140 in a state that the cover is closed. For reference, a sectional view of the power transmission unit 140 in a state in FIG. 8A is the same as that illustrated in FIG. 6.

As shown in FIG. 8A, if the cover is opened, the cover connecting rod 109 is rotated to a direction J in order to close the cover, and accordingly, the link plate 108 moves in a direction K with respect to the stud 105. Also, since the force operating part 1441*b* of the first selectively connecting member 1441 inserted into the inserting hole 108*b* of the link plate 108 receives force in a direction L, the first selectively connecting member 1441 is rotated in the forward direction E. Accordingly, the power transmission unit 140 is under the same state as that illustrated in FIG. 8B. At this time, a force operating part inserting groove 103*c* of the side plate 103 may be properly determined according to a rotational range of the first selectively connecting member 1441.

Meanwhile, as the first selectively connecting member 1441 rotates in the forward direction E, the assembling member 1420 upwardly moves in the direction of the rotational axial line A. As a result, the driven connecting part 163*b* and the driven side assembling part 1421 of the assembling member 1420 engage or contact each other, and the assembling member 1420 and the developing roller 163 are in a state capable of rotating together. Therefore, the first selectively connecting member 1441 determines whether the power is transmitted from the power distributing gear 106 to the developing roller 163.

If the cover is closed, the cover connecting rod 109, the link plate 108 and the first selectively connecting member 1441 are reversely moved from the state in FIG. 8B to the state in FIG. 8A when the cover is opened during a printing process of the image forming apparatus 100. As a result, the driven connecting part 163*b* and the driven side assembling part 1421 of the assembling member 1420 disengage and the power transmission to the developing roller 163 is blocked regardless of the operation of the first selectively connecting member 1441.

Meanwhile, if in each of the other three inserting holes 108*b* of the link plate 108 the power transmission unit 140 is provided to drive one of the other three developing cartridges 160, the user can transmit and block the power to the four developing cartridges 160 by opening and closing the cover. Accordingly, if the user opens the cover so as to extract the developing cartridges 160 from the inside of the image forming apparatus 100, the power transmission is automatically blocked by an engagement of the developing cartridges 160 with the cover, thereby enhancing the user's convenience.

Also, an impact from bumping of the conventional developing device driving transmission gears (see 7C, 7M, 7Y, and 7K in FIG. 1A) and the driven gear (see 23*a* in FIG. 1A) to the developing roller 23 when the developing cartridges 160 are mounted or detached can be minimized.

Furthermore, since the problem of non-uniform engagement between the gear rows is prevented, the developing roller 163 of the developing cartridges 160 can be more precisely and stably driven.

An image forming apparatus according to another embodiment of the present invention includes a power transmission unit having a mid-medium member. The detailed description of the other components will be omitted they are the same as the embodiment described with reference to FIGS. 2-8.

Figure 9:
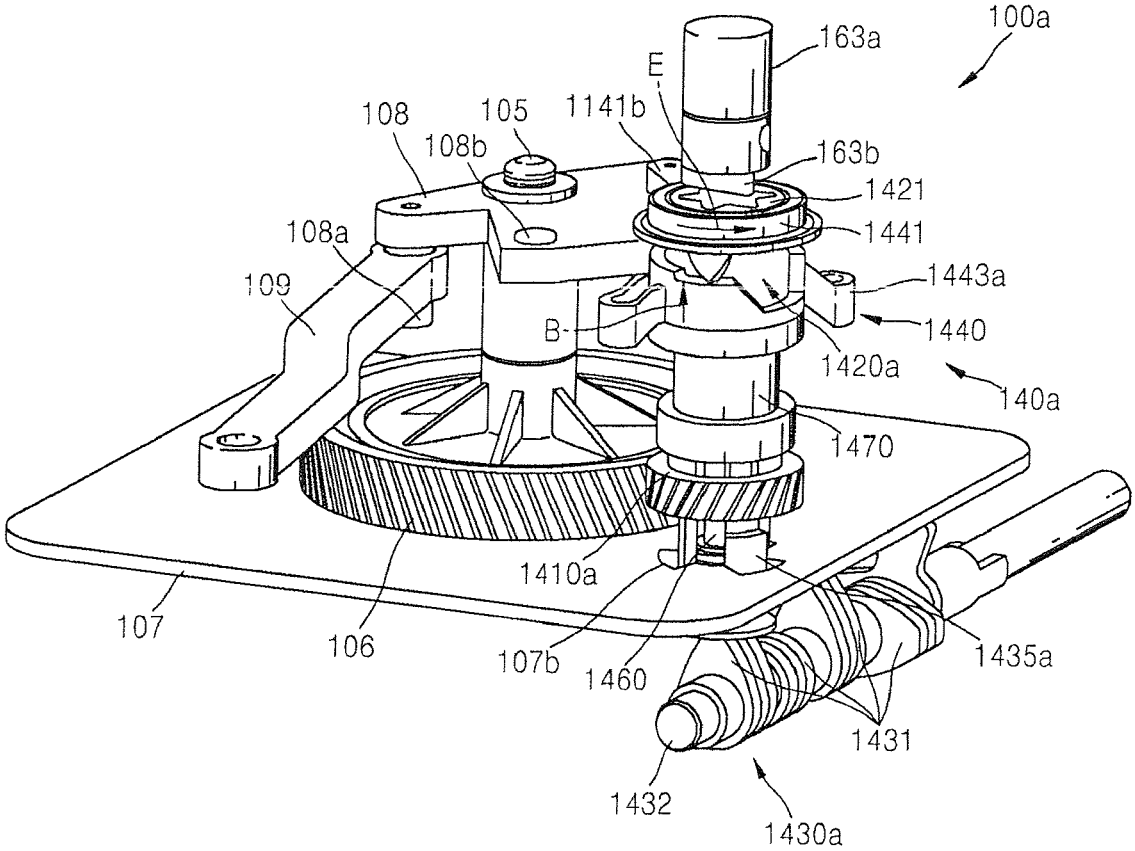
FIG. 9 is a perspective view of a power transmission unit according to another embodiment of the present invention.
Figure 10:
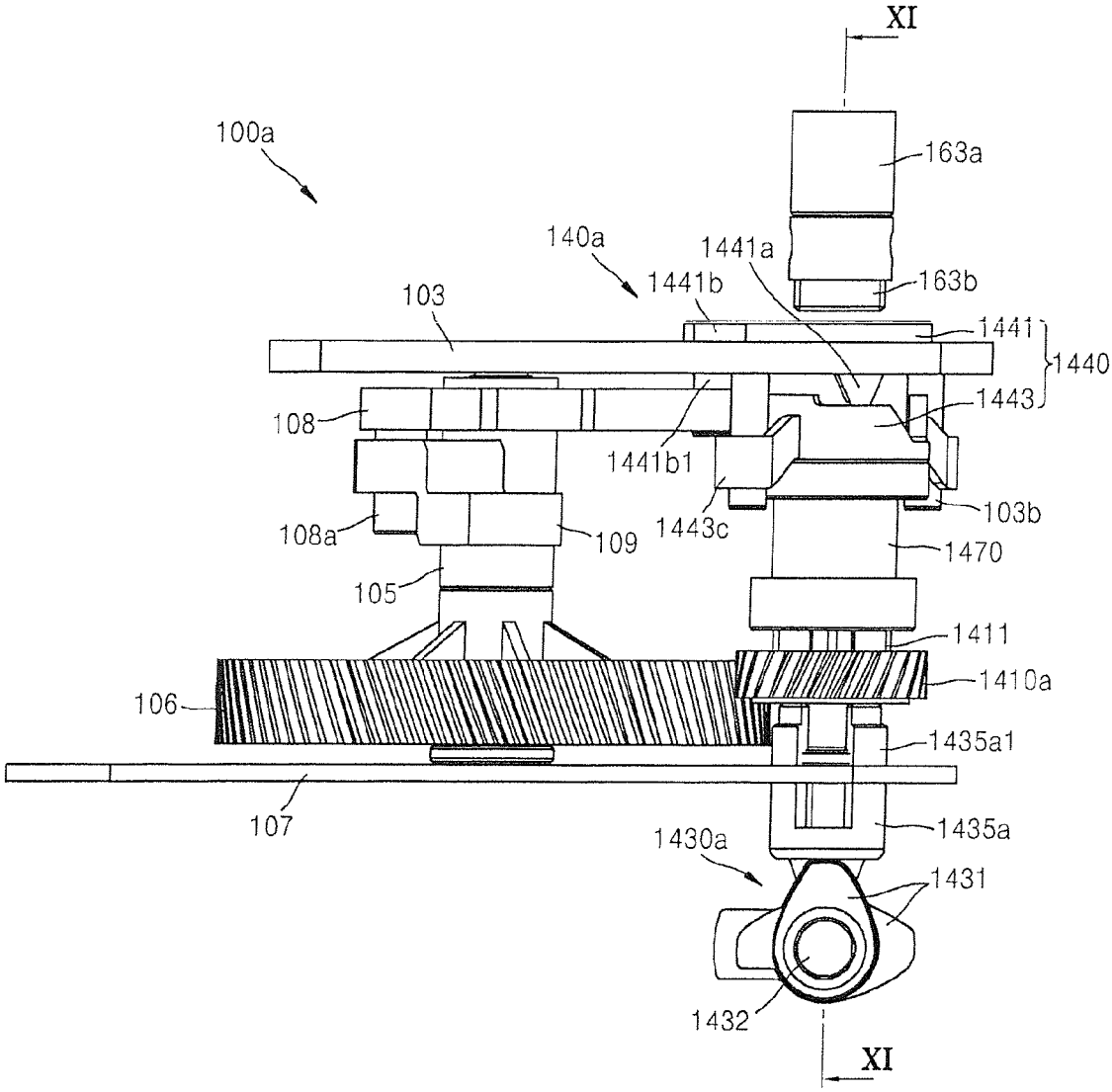
FIG. 10 is a front view of a power transmission unit according to another embodiment of the present invention.
Figure 11:
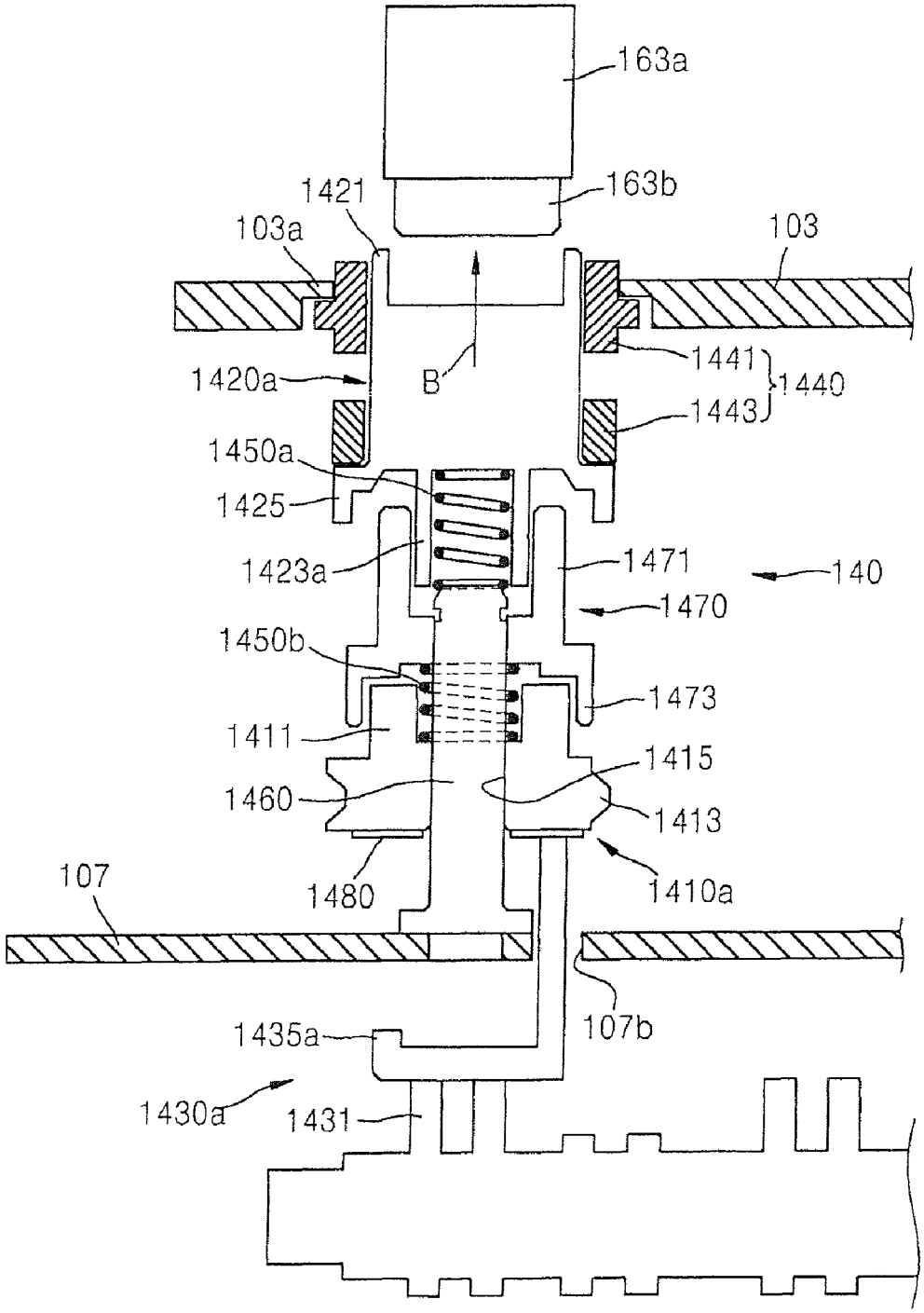
FIG. 11 is a sectional view of a power transmission unit according to another embodiment of the present invention.

FIGS. 9 to 11 illustrate the power transmission unit 140*a* including the mid-medium member 1470 in a state that the cover is opened. As shown in FIGS. 9 to 11, the power transmission unit 140*a* according to another embodiment of the present invention includes a transmission member 1410*a*, an assembling member 1420*a*, a first selectively connecting part 1430*a*, a second selectively connecting part 1440*a*, and the mid-medium member 1470 that is provided between the transmission member 1410*a* and the assembling member 1420*a*.

The transmission member 1410*a* includes a through hole 1415 inside which a center supporting member 1460 is inserted along a rotational axial line A. A washer 1480 may be provided in a lower end part of the transmission member 1410*a* to prevent the transmission member 1410*a* from being worn out by a friction between the transmission member 1410*a* and a cam medium member 1435*a*.

A driving side assembling part 1423*a* of the assembling member 1420*a* is provided in the shape of a male coupling in comparison with a female coupling shape of the driving side assembling part 1423 (FIG. 6), and engages and disengages a first medium assembling part 1471 of the mid-medium member 1470.

As shown in FIG. 10, the cam medium member 1435*a* of the first selectively connecting part 1430*a* includes a flange 1435*a*1 separated along the circumference so that an inside frame 107 can support the center supporting member 1460. In the inside frame 107 is formed the through hole (see 107*b* in FIGS. 9 and 11) corresponding to the shape of the flange 1435*a*1 so that the flange 1435*a*1 can thoroughly rotate upward and downward. It is understood that the upward and downward represent directions toward and away from, respectively, the developing cartridge 160.

Meanwhile, the center supporting member 1460 may be provided as a stud having the rotational axial line A as a centering line. The center supporting member 1460 passes through the transmission member 1410*a* and the mid-medium member 1470 to more stably support the rotational movement of the transmission member 1410*a* and the mid-medium member 1470 with respect to the rotational axial line A. The center supporting member 1460 is fixedly coupled with the inside frame 107, such that the transmission member 1410*a* and the mid-medium member 1470 can slide along the center supporting member 1460. In addition, the center supporting member 1460 may be provided in various shapes to support the rotation of the transmission member 1410*a* and the mid-medium member 1470. However, it is understood that according to other aspects of the present invention, the center supporting member 1460 may be omitted, as necessary.

The mid-medium member 1470 includes the first medium assembling part 1471 that engages and disengages the driving side assembling part 1423*a* of the assembling member 1420*a* along the rotational axial line A, and a second medium assembling part 1473 that always engages the driving connecting part 1411 of the transmission member 1410*a*.

The mid-medium member 1470 rotates or moves upward and downward while connected to or engaging the transmission member 1410*a* if the transmission member 1410*a* rotates or moves upward and downward along the rotational axial line A. That is, if the first selectively connecting part 1430*a* enables the transmission member 1410*a* to rotate or move downward along the rotational axial line A, the mid-medium member 1470 also rotates or moves downward with the transmission member 1410*a*. Accordingly, the first medium assembling part 1471 disengages from the driving side assembling part 1423*a* of the assembling member 1420*a*. On the other hand, if the first selectively connecting part 1430*a* enables the transmission member 1410*a* to rotate or move upward along the rotational axial line A, the first medium assembling part 1471 engages the driving side assembling part 1423*a* of the assembling member 1420*a* in the direction of the rotational axial line A.

Meanwhile, as shown in FIG. 11, a first elastic member 1450*a* and a second elastic member 1450*b* are provided between the assembling member 1420*a* and the mid-medium member 1470 and between the mid-medium member 1470 and transmission member 1410*a*, respectively. An elasticity of the second elastic member 1450*b* may be greater than an elasticity of the first elastic member 1450*a* so as to elastically pressurize the second selectively connecting part 1440 in the upward direction. Also, the first elastic member 1450*a* and the second elastic member 1450*b* may be provided to have larger inside diameter than an external diameter of the center supporting member 1460 so that the mid-medium member 1470 and the transmission member 1410*a* movement may not be hindered by an interference from an interaction of the first elastic member 1450*a* or the second elastic member 1450*b* with the center supporting member 1460.

If the cover (not shown) is closed in the image forming apparatus 100*a* including the power transmission unit 140*a* having the above-described configuration, a first selectively connecting member 1441 of the second selectively connecting part 1440 rotates in a forward direction E and a circumference cam 1441 and the circumference cam profile 1443 are reciprocally operated. Since the elasticity F1 of the second elastic member 1450*b* is greater than the elasticity F2 of the first elastic member 1450*a*, the second selectively connecting member 1443 enables the assembling member 1420*a* to rotate in an upward direction B. Accordingly, a driven side assembling part 1421 of the assembling member 1420*a* engages a driven connecting part 163*b* in the direction of the rotational axial line A. Therefore, the first medium assembling part 1471 of the mid-medium member 1470 engages and disengages the driving side assembling part 1423*a* according to the first selectively connecting part 1430*a* in order to transmit or block the power of a power distributing gear 106 to/from developing roller 163.

Figure 12:
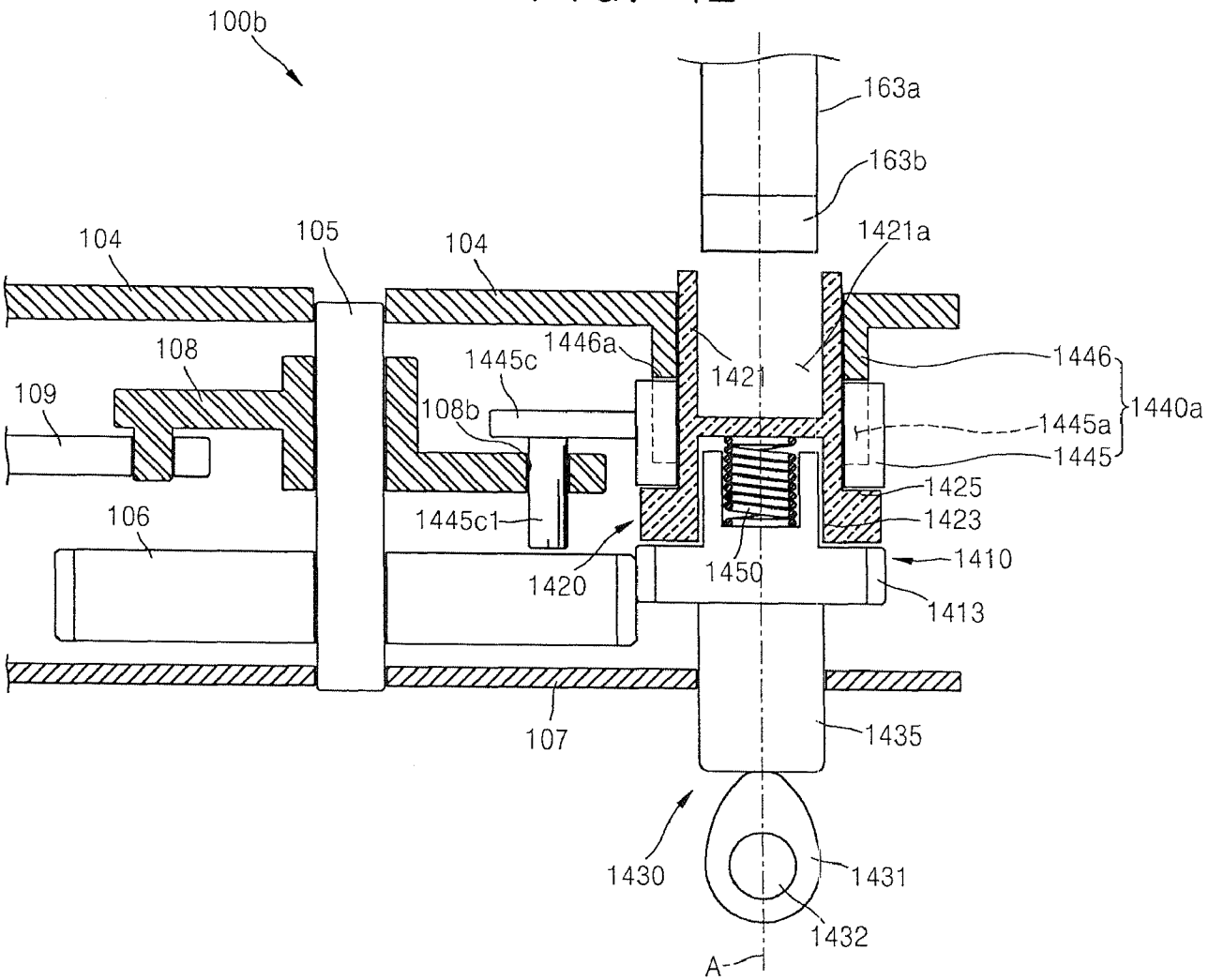
FIGS. 12 and 13 are sectional views of a power transmission unit according to yet another embodiment of the present invention when a cover is opened and closed, respectively.
Figure 13:
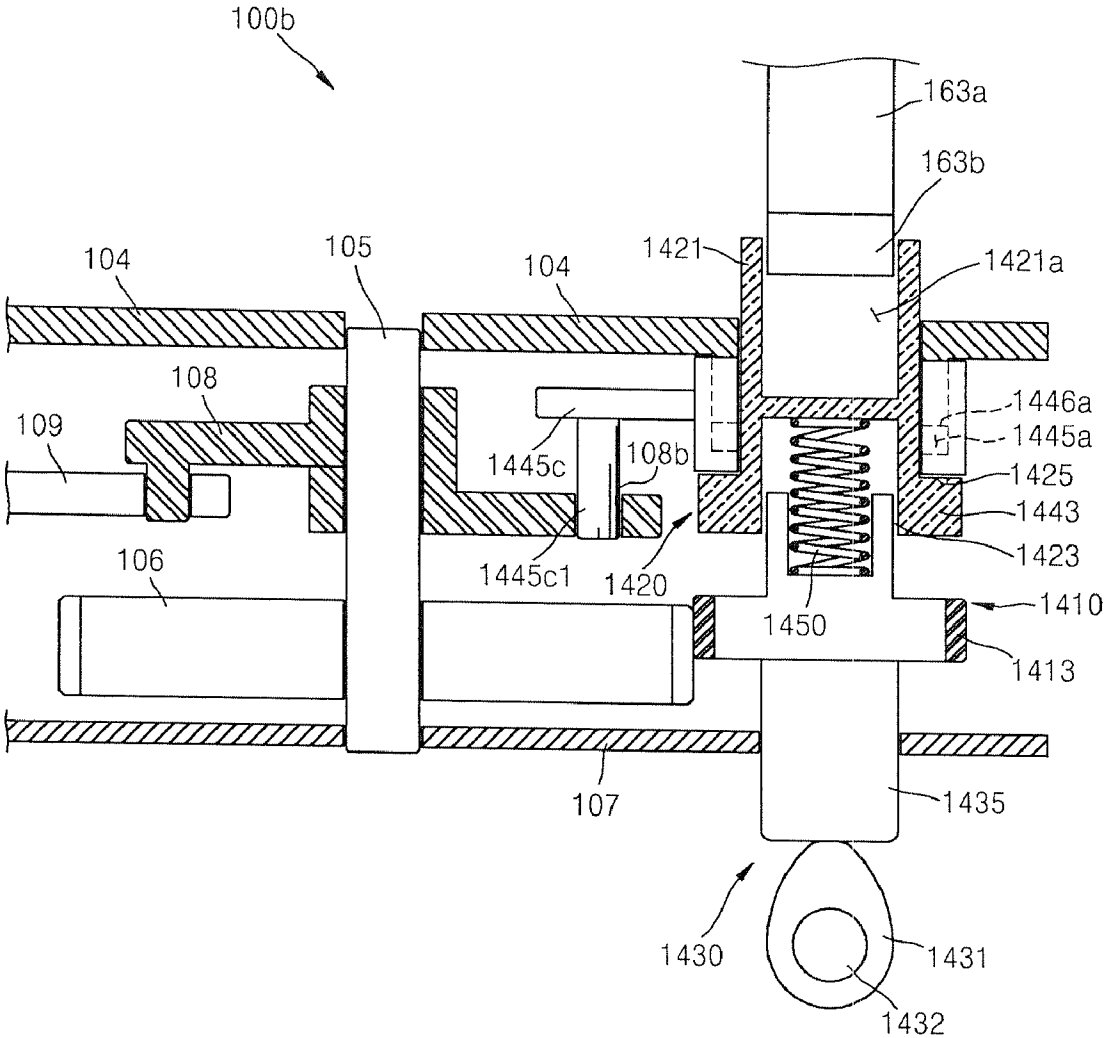

An image forming apparatus 100*b* according to yet another embodiment of the present invention will be described with reference to FIGS. 12 and 13. FIGS. 12 and 13 are sectional views of a power transmission unit where the cover is opened and closed, respectively. Here, the transmission member 1410 and the driving side assembling part 1423 of the assembling member 1420 are coupled to each other by the first selectively connecting part 1430.

Referring to FIGS. 12 and 13, the image forming apparatus 100*b* includes a second selectively connecting part 1440*a*, different from the second selectively connecting parts 1440 of the embodiments described with reference to FIGS. 2 through 11. Specifically, the second selectively connecting parts 1440*a* includes a first selectively connecting member 1446 and a second selectively connecting member 1445 that are formed integrally with a side frame 104.

The second selectively connecting member 1445 has a cylindrical shape and is formed with a circumference cam profile 1445*a*. The circumference cam profile 1445*a* approaches and separates from a circumference cam 1446*a* of the first selectively connecting member 1446 as the second selectively connecting member 1445 rotates in forward and reverse directions while contacting the circumference cam 1446*a* of the first selectively connecting member 1446. Accordingly, as shown in FIG. 13, the assembling member 1420 engages the driven connecting part 163*b* as the second selectively connecting member 1445 approaches the first selectively connecting member 1446. In contrast, the assembling member 1420 disengages from the driven connecting member 163*b* as the second selectively connecting member 1445 separates from the first selectively connecting member 1446. That is, the second selectively connecting part 1440*a* illustrated in FIGS. 12 and 13 has the same functionality as the second selectively connecting parts 1440 illustrated in FIGS. 2 through 11 in that the second selectively connecting member 163*b*.

As compared to the second selectively connecting member 1443 described with reference to FIGS. 2 through 11, the second selectively connecting member 1445 illustrated in FIGS. 12 and 13 has no guide groove part. Accordingly, the side frame 104 also has no guide projection to be inserted in the guide groove part.

In the meantime, the second selectively connecting member 1445 includes a force operating part 1445*c* to receive a rotational moment while interlocking with an opening and/or closing of the cover (not shown). The force operating part 1445*c* includes a link plate inserting projection 1445*c*1 to be inserted into the inserting hole 108*b* of the link plate 108. Accordingly, the second selectively connecting member 1445 rotates in forward and reverse directions while interlocking with the opening and/or closing of the cover, thereby causing the driven side assembling part 1421 of the assembling member 1420 to engage with and disengage from the driven connecting part 163*b*. Here, the link plate inserting projection 1445*c*1 has a proper height to receive the rotational moment even though the second selectively connecting member 1445 moves along the rotational axial line A.

As compared to the embodiments described with reference to FIGS. 2 through 11, the first selectively connecting member 1446 and the side frame 104 are formed as a single body, and the guide projection 103*b* and the guide groove part 1443*c* are not included, so that the structure is simplified.

Referring back to FIG. 11, the developing roller has been exemplified as the driven rotational body in the present description. However, it is understood that the power transmission unit according to aspects of the present invention may be applied to other rotational bodies. Also, in the above description, a multi-pass type electrophotographic image forming apparatus using one photosensitive drum and one light scanning unit has been exemplified. However, it is understood that the power transmitting unit according to aspects of the present invention may be applied to other image forming apparatuses having rotational bodies.

As described above, the image forming apparatus and the power transmission unit thereof according to aspects of the present invention have the following advantages. First, power can be stably transmitted to a driven rotational body that is detachable from the main body, such as the developing roller. Second, since an interval between the developing roller of the developing cartridge and the photosensitive drum can be provided uniformly, and impact applied to the developing roller can be minimized when the power is transmitted and blocked, toner can be more uniformly supplied to the photosensitive drum thereby improving an image quality. Also, since the power is stably transmitted, a uniform image quality can be ensured for a long time. Third, the impact applied to the developing cartridge through the developing roller can be minimized when the developing cartridge is mounted and detached. Fourth, the power transmission and the blocking of power to the developing roller are performed simultaneously while opening and closing the cover, thereby enhancing a user's convenience.

Although a few embodiments of the present invention have been shown and described, it will be appreciated by those skilled in the art that changes may be made in this embodiment without departing from the principles and spirit of the invention, the scope of which is defined in the claims and their equivalents.

What is claimed is:

1. An image forming apparatus comprising:

a driven rotational body that is detachable from the image forming apparatus and comprises a driven connecting part;

a transmission member that receives a rotational power and comprises a driving connecting part provided along a direction of a rotational axial line of the driven rotational body and movable along the direction of the rotational axial line; and an assembling member that receives the rotational power from the transmission member, transmits the rotational power to the driven rotational body to rotate the driven rotational body, and comprises:

a driven side assembling part to connect to the driven connecting part, and a driving side assembling part to connect to the driving connecting part.

2. The image forming apparatus as claimed in claim 1, wherein:

the transmission member comprises a power receiving part to receive the rotational power; and the image forming apparatus further comprises a driving part to drive the power receiving part.

3. The image forming apparatus as claimed in claim 1, further comprising:

a first selectively connecting part to selectively move the transmission member along the direction of the rotational axial line so that the driving connecting part engages or disengages from the driving side assembling part of the assembling member.

4. The image forming apparatus as claimed in claim 3, wherein the first selectively connecting part comprises a cam and/or a solenoid.

5. The image forming apparatus as claimed in claim 3, further comprising:

a controller to control the first selectively connecting part to engage the driving connecting part with the driving side assembling part if the driven rotational body requires the rotational power.

6. The image forming apparatus as claimed in claim 1, further comprising:

a second selectively connecting part to selectively move the assembling member along the direction of the rotational axial line so that the driven side assembling part engages or disengages from the driven connecting part of the driven rotational body.

7. The image forming apparatus as claimed in claim 6, wherein the second selectively connecting part comprises:

a first selectively connecting member to rotate about the rotational axial line; and a second selectively connecting member connected to the assembling member such that the second selectively connecting member moves together with the assembling member toward or away from the driven connecting part according to a direction that the first selectively connecting member rotates.

8. The image forming apparatus as claimed in claim 7, wherein the driven side assembling part engages the driven connecting part when the first selectively connecting member rotates in a first direction until the second selectively connecting member can no longer move toward the driven connecting part.

9. The image forming apparatus as claimed in claim 7, wherein:

one of the first selectively connecting member and the second selectively connecting member comprises a cam provided along a circumference about the rotational axial line, and an other of the first selectively connecting member and the second selectively connecting member comprises a cam profile that reciprocally operates in contact with the cam.

10. The image forming apparatus as claimed in claim 7, wherein the second selectively connecting part comprises:

a force operating part to receive a rotational moment from an outside source enabling the first selectively connecting member to rotate.

11. The image forming apparatus as claimed in claim 7, further comprising:

a cover that opens and closes, wherein the first selectively connecting member rotates in a first direction when the cover close and rotates in a second direction when the cover opens.

12. The image forming apparatus as claimed in claim 1, further comprising:

an elastic member provided between the assembling member and the transmission member to apply an elastic force in a direction to separate the assembling member and the transmission member from each other.

13. The image forming apparatus as claimed in claim 1, wherein the driving connecting part and the driven connecting part are separated by a predetermined separating distance in a state when the driven side assembling part is not connected to the driven connecting part.

14. The image forming apparatus as claimed in claim 1, further comprising:

a mid-medium member provided between the transmission member and the assembling member, and comprising:

a first medium assembling part to engage or disengage the driving side assembling part according to a movement of the transmission member; and a second medium assembling part to always engage the driving connecting part of the transmission member.

15. The image forming apparatus as claimed in claim 1, further comprising an image receptor, and wherein the driven rotational body comprises a plurality of developing rollers to develop the image receptor.

16. A power transmission unit to transmit a rotational power to a driven rotational body having a driven connecting part, the power transmission unit comprising:

a transmission member that receives the rotational power and comprises a driving connecting part provided along a direction of a rotational axial line of the driven rotational body and movable along the direction of the rotational axial line; and an assembling member that receives the rotational power from the transmission member, transmits the rotational power to the driven rotational body, and comprises:

a driven side assembling part to connect to the driven connecting part, and a driving side assembling part to connect to the driving connecting part.

17. The power transmission unit as claimed in claim 16, wherein the transmission member comprises a power receiving part to receive the rotational power.

18. The power transmission unit as claimed in claim 16, further comprising:

a first selectively connecting part to selectively move the transmission member along the direction of the rotational axial line so that the driving connecting part engages or disengages from the driving side assembling part of the assembling member.

19. The power transmission unit as claimed in claim 18, wherein the first selectively connecting part comprises a cam and/or a solenoid.

20. The power transmission unit as claimed in claim 18, further comprising:

a controller to control the first selectively connecting part to engage the driving connecting part with the driving side assembling part if the driven rotational body requires the rotational power.

21. The power transmission unit as claimed in claim 16, further comprising:

a second selectively connecting part to selectively move the assembling member along the direction of the rotational axial line so that the driven side assembling part engages or disengages from the driven connecting part of the driven rotational body.

22. The power transmission unit as claimed in claim 21, wherein the second selectively connecting part comprises:

a first selectively connecting member to rotate about the rotational axial line; and a second selectively connecting member connected to the assembling member such that the second selectively connecting member moves together with the assembling member toward or away from the driven connecting part according to a direction that the first selectively connecting member rotates.

23. The power transmission unit as claimed in claim 22, wherein the driven side assembling part engages the driven connecting part when the first selectively connecting member rotates in a first direction until the second selectively connecting member can no longer move toward the driven connecting part.

24. The power transmission unit as claimed in claim 22, wherein:

one of the first selectively connecting member and the second selectively connecting member comprises a circumference cam provided along a circumference about the rotational axial line, and an other of the first selectively connecting member and the second selectively connecting member comprises a circumference cam profile that reciprocally operates in contact with the cam.

25. The power transmission unit as claimed in claim 22, wherein the first selectively connecting member comprises:

a force operating part to receive a rotational moment from an outside source enabling the first selectively connecting member to rotate.

26. The power transmission unit as claimed in claim 25, wherein the force operating part receives the rotational moment from an opening and a closing of a cover such that the first selectively connecting member rotates in a first direction when the cover close and rotates in a second direction when the cover opens.

27. The power transmission unit according to claim 22, wherein the second selectively connecting member is provided between the assembling member and the first selectively connecting member and moves along the direction of the rotational axis line while interlocking with the assembling member.

28. The power transmission unit according to claim 27, further comprising a side frame to prevent the first selectively connecting member from being separated toward the driven connecting part by a force applied to separate the assembling member and the transmission member from each other, wherein the first selectively connecting member and the side frame are formed as a single body.

29. The power transmission unit as claimed in claim 16, further comprising:

an elastic member provided between the assembling member and the transmission member to apply an elastic force in a direction to separate the assembling member and the transmission member from each other.

30. The power transmission unit as claimed in claim 16, wherein the driving connecting part and the driven connecting part are separated by a predetermined separating distance in a state when the driven side assembling part is not connected to the driven connecting part.

31. The power transmission unit as claimed in claim 16, further comprising:

a mid-medium member provided between the transmission member and the assembling member, and comprising:

a first medium assembling part to engage or disengage the driving side assembling part according to a movement of the transmission member; and a second medium assembling part to always engage the driving connecting part of the transmission member.

32. An image forming apparatus including a cover and a detachable driven rotational body having a driven connecting part to receive a rotational power, the image forming apparatus comprising:

an assembling member comprising a driven side assembling part to connect to the driven connecting part and to transmit the rotational power to the driven connecting part; and a selectively connecting part to connect or disconnect the driven side assembling part to/from the driven connecting part by moving the assembling member toward or away from the driven connecting part according to an opening or a closing of the cover.

33. The image forming apparatus as claimed in claim 32, further comprising:

a transmission member that receives the rotational power and comprises a driving connecting part provided along a direction of a rotational axial line of the driven rotational body, wherein the assembling member further comprises a driving side assembling part to connect to the driving connecting part to receive the rotational power from the transmission member.

34. The image forming apparatus as claimed in claim 33, further comprising:

another selectively connecting part to selectively move the transmission member along the direction of the rotational axial line so that the driving connecting part engages or disengages from the driving side assembling part of the assembling member.

35. The image forming apparatus as claimed in claim 34, further comprising:

a controller to control the other selectively connecting part to engage the driving connecting part with the driving side assembling part if the driven rotational body requires the rotational power.

* * * * *